US008424692B2

(12) United States Patent
Ala

(10) Patent No.: US 8,424,692 B2
(45) Date of Patent: Apr. 23, 2013

(54) HEIGHT-ADJUSTABLE SUPPORTING DEVICE FOR AN ELECTRIC HOUSEHOLD OR REFRIGERATOR SHELF

(75) Inventor: Gianbattista Ala, Volpiano (IT)

(73) Assignee: ITW Industrial Components S.R.L., Milan (IT)

( * ) Notice: Subject to any disclaimer, the term of this patent is extended or adjusted under 35 U.S.C. 154(b) by 280 days.

(21) Appl. No.: 12/933,893

(22) PCT Filed: Jun. 1, 2009

(86) PCT No.: PCT/IB2009/052302

§ 371 (c)(1),
(2), (4) Date: Sep. 22, 2010

(87) PCT Pub. No.: WO2009/147612

PCT Pub. Date: Dec. 10, 2009

(65) Prior Publication Data

US 2011/0017890 A1 Jan. 27, 2011

(30) Foreign Application Priority Data

Jun. 6, 2008 (IT) ..... TO2008A0436

(51) Int. Cl.

| | |
|---|---|
| ***A47G 19/08*** | (2006.01) |
| *A47F 5/00* | (2006.01) |
| *A47B 96/04* | (2006.01) |
| *B08B 3/00* | (2006.01) |

(52) U.S. Cl.

USPC ..... 211/41.9; 211/175; 312/408; 134/135

(58) Field of Classification Search ..... 211/41.9, 211/175, 126.15, 151, 162; 312/311, 410, 312/228.1, 228, 408, 319.1; 134/135; 403/107; 248/274.1, 298.1, 295.11

See application file for complete search history.

(56) References Cited

U.S. PATENT DOCUMENTS

| | | | | | |
|---|---|---|---|---|---|
| 244,682 | A | * | 7/1881 | Snyder | 101/404 |
| 2,201,274 | A | * | 5/1940 | Singer | 128/838 |
| 3,469,870 | A | * | 9/1969 | Barkus | 403/107 |
| 3,560,069 | A | * | 2/1971 | Doepke | 312/351 |
| 3,640,399 | A | * | 2/1972 | Hartman | 211/175 |
| 3,822,085 | A | * | 7/1974 | Clark | 312/351 |
| 4,097,099 | A | * | 6/1978 | Spiegel | 312/311 |
| 4,875,584 | A | * | 10/1989 | Ackeret | 206/387.12 |

(Continued)

FOREIGN PATENT DOCUMENTS

| | | | |
|---|---|---|---|
| DE | 4227585 | A1 | 2/1994 |
| EP | 0033483 | A2 | 8/1981 |
| EP | 0901770 | A2 | 3/1999 |
| WO | 2008035866 | A1 | 3/2008 |

OTHER PUBLICATIONS

ISR for PCT/IB2009/052302 mailed May 27, 2010.

*Primary Examiner* — Jonathan Liu
*Assistant Examiner* — Devin Barnett
(74) *Attorney, Agent, or Firm* — Lowe Hauptman Ham & Berner LLP

(57) ABSTRACT

A supporting device for an inner supporting member of an electric household appliance, which includes a support securable, in use, by a first part thereof to a fixed guide and a second part facing the first, to a side edge of the inner supporting member. Both parts are relatively movable in a sliding direction perpendicular to the supporting member. Further included is a releasable retaining means for blocking the second part in different positions.

10 Claims, 3 Drawing Sheets

U.S. PATENT DOCUMENTS 5,474,378 A * 12/1995 Smith et al. ..... 312/334.4
5,595,200 A * 1/1997 Favaro ..... 134/201
5,657,878 A * 8/1997 Austin ..... 211/41.8
5,860,716 A * 1/1999 Good et al. ..... 312/311
6,974,040 B2 * 12/2005 Jahrling ..... 211/41.8
7,032,604 B2 * 4/2006 Welch ..... 134/135
7,168,578 B2 * 1/2007 Mersch et al. ..... 211/41.8
7,410,228 B2 * 8/2008 Dickson et al. ..... 312/311
7,534,065 B2 * 5/2009 Rejman et al. ..... 403/328
7,731,805 B2 * 6/2010 Banta et al. ..... 134/56 D
2004/0103932 A1 * 6/2004 Kim ..... 134/137
2006/0119236 A1 * 6/2006 Dickson et al. ..... 312/311
2006/0250058 A1 * 11/2006 Stevens et al. ..... 312/311
2007/0035220 A1 * 2/2007 Bond et al. ..... 312/319.1
2008/0110480 A1 * 5/2008 Choi et al. ..... 134/135
2008/0129168 A1 * 6/2008 Banta et al. ..... 312/333
2008/0272072 A1 * 11/2008 Tynes et al. ..... 211/41.8
2010/0066227 A1 * 3/2010 Ramm et al. ..... 312/408
2011/0018410 A1 * 1/2011 Bastuji et al. ..... 312/228.1
2012/0074080 A1 * 3/2012 Garcia et al. ..... 211/41.9
2012/0111366 A1 * 5/2012 Baldwin et al. ..... 134/18
2012/0153786 A1 * 6/2012 Kucuk et al. ..... 312/228

* cited by examiner

HEIGHT-ADJUSTABLE SUPPORTING DEVICE FOR AN ELECTRIC HOUSEHOLD OR REFRIGERATOR SHELF

RELATED APPLICATIONS

The present application is national phase of International Application Number PCT/IB2009/052302 filed Jun. 1, 2009, and claims priority from, Italian Application Number TO2008A000436, filed Jun. 6, 2008.

TECHNICAL FIELD

The present invention relates to a height-adjustable supporting device for an electric household appliance inner supporting member, such as a dishwasher rack or an inner supporting shelf of a refrigerator or freezer.

BACKGROUND ART

The problem of allowing users to adjust the height of the upper extractable rack within the washing compartment of the machine, e.g. to be able to allow dishes of different height to be inserted (e.g. plates of different diameter or tumblers and wine glasses) into the dishwasher rack, thus always optimizing the available space, is particularly felt in the dishwasher industry. For example, an adjustment device is known from EP0033483; it is based on side supporting members for the rack, normally engaging the fixed guides of the dishwasher, provided with two upper and lower parts reciprocally and vertically sliding, which may be fixed at different heights by means of disconnectable blocking portions thereof.

Such a device however has relatively complex structure and operation, and may thus cause jamming; furthermore, it is in any case costly, large in size and relatively complex to be used by the user. Moreover, the above-described device is not adapted to be used in other applications, e.g. for adjusting the position of the inner supporting shelves of a refrigerator or freezer in height, where today the need to allow the user to make this adjustment in a simple and rapid manner and with small volumes, is also very felt, in order to allow, even in this case, the stowage of food of different size into the inner volume of the electric household appliance to be optimized.

DISCLOSURE OF INVENTION

It is thus an object of the present invention to provide a height-adjustable supporting device for an electric household appliance inner supporting member designed to eliminate the above-mentioned drawbacks and, in particular, to display low production cost, reduced dimensions (in particular, transversally to the fixed supporting guides present in the electric household appliance), a high use and assembly easiness, and an absolute operation reliability.

Furthermore, it is an object of the invention to achieve these results along with the possibility of being able to change the position in height of the supporting member within the electric household appliance, not only between two different positions, as most of the known devices, but between a plurality (three or more) different positions.

According to the present invention, a height-adjustable supporting device for an electric household appliance inner supporting member, such as, for example, a dishwasher rack or an inner supporting shelf of a refrigerator or freezer, is thus provided as set forth in claim 1.

In particular, the supporting device of the invention comprises a support securable, in use, by means of a first part thereof to a fixed guide, e.g. present in an inner compartment, such as the washing compartment of a dishwasher or the refrigerated compartment of a refrigerator or freezer, and by means of a second part thereof, opposite to and facing the first, to a side edge of the inner supporting member of the electric household appliance.

The second part of the support is movably carried by the first part in a relative sliding direction therebetween, which direction is perpendicular to a laying plane of the inner supporting member; the device further comprises releasable retaining means or a releasable retaining element for blocking the second part with respect to the first in a plurality of different positions along the relative sliding direction.

According to an aspect of the invention, the releasable retaining means comprise: a pin carried by the first part of the support overhangingly protruding towards the second part of the support in a direction which is transversal, in use, to the fixed guide, the pin being further sliding on the first part of the support against the bias of first elastic means in a direction which is parallel, in use, to the fixed guide; and a desmodromic sliding track for a free end of the pin, the track being divided into a first and a second branch integrally obtained, respectively, within the second part of the support and within a slide slidingly carried, against the bias of second elastic means or a second elastic member, by the second part of the support in the relative sliding direction between the latter and the first part.

Hereinafter, "desmodromic track" means a sliding track which is shaped so as to present two branches interconnected in a closed path and which may be selectively engaged by a movable member, in the above-described case the pin, so that the track may be covered as a whole by the movable member by means of a transversal displacement of the movable member which determines the transfer thereof from one track branch to the other.

According to the invention, the first branch is provided with a plurality of resting teeth for the pin, which are arranged in sequence along said sliding direction and aligned with an equal number of first openings facing the second branch and the latter is separated from the first by a wall of the slide, which wall displays in turn a plurality of second openings for the pin, facing the first branch and held by the second elastic means in an offset position from the first openings in the relative sliding direction.

Furthermore, the first elastic means are mounted so as to be preloaded to push the pin, transversally to its own axis, against the wall of the slide which separates the second branch of the desmodromic track from the first branch.

According to a further aspect of the invention, the first openings are laterally and thoroughly obtained through a longitudinal ridge integrally carried by the second part of the support and parallelly aligned to the relative sliding direction, so as to separate the first track branch from the second, which is integrally provided towards the first branch of the track with the aforesaid resting teeth, which are saw-tooth-shaped in the relative sliding direction.

Furthermore, the resting teeth define an equivalent number of supporting shoulders for the free end of the pin along said relative sliding direction, by means of which the first part of the support bears in use the second part through the pin. In order to ensure the correct operation of the whole, the second branch of the desmodromic track is longer than the longitudinal ridge of the second part of the support and ends, on the side opposite to the shoulders, with a curved end facing the first branch and aligned with one of said second openings.

Finally, the second elastic means consist in a spring mounted so as to be preloaded and sandwiched between the slide and the second part of the support in the relative sliding direction, so as to allow, in use, a relative movement between the slide and the second part of the support against the bias of the spring, in order to produce the alignment between the first and second openings so as to interconnect the first and second branches of the desmodromic track, both in correspondence with the teeth and in correspondence with the curved end of the second branch, thus allowing the pin to selectively engage the first and second branches of the desmodromic track.

Thereby, a supporting device is obtained having a highly effective, compact selective blocking mechanism between the reciprocally movable parts, which may be implemented so as to allow to have two, three or more (or "n", where "n" is an integer as desired) different adjustment positions, the mechanism which may be simply actuated by manually imparting a push to the shelve or rack to be moved, generally upwards. Furthermore, the so obtained supporting device as a whole has small dimensions, in particular transversally to the guides, is absolutely reliable, simple and cost-effective to be implemented and easy to be used, and may possibly be also provided with a handle control for manually producing the relative translation between the slide and the second part of the support.

BRIEF DESCRIPTION OF THE DRAWINGS

Further features and advantages of the present invention will be apparent from the following description of a preferred embodiment thereof, merely provided by way of non-limitative example, with reference to the accompanying drawings, in which.

BEST MODE FOR CARRYING OUT THE INVENTION

Figure 1:
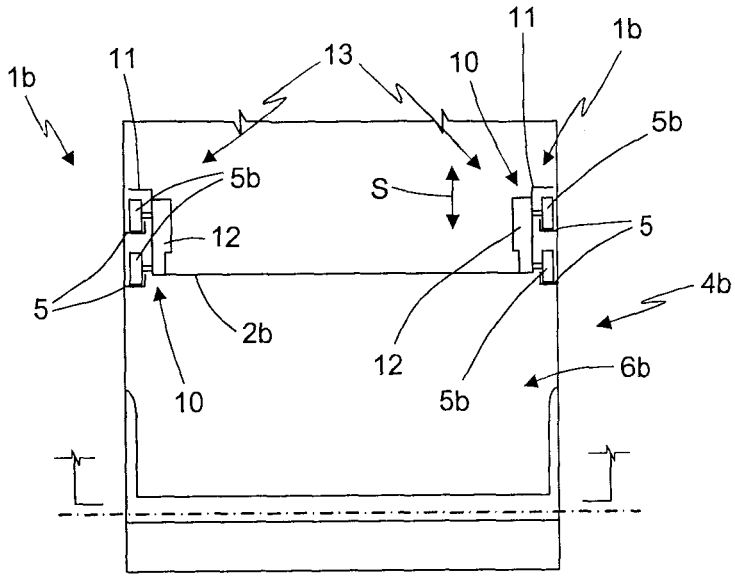
FIGS. 1 and 2 diagrammatically show two possible applications of the supporting device according to the invention.
Figure 2:
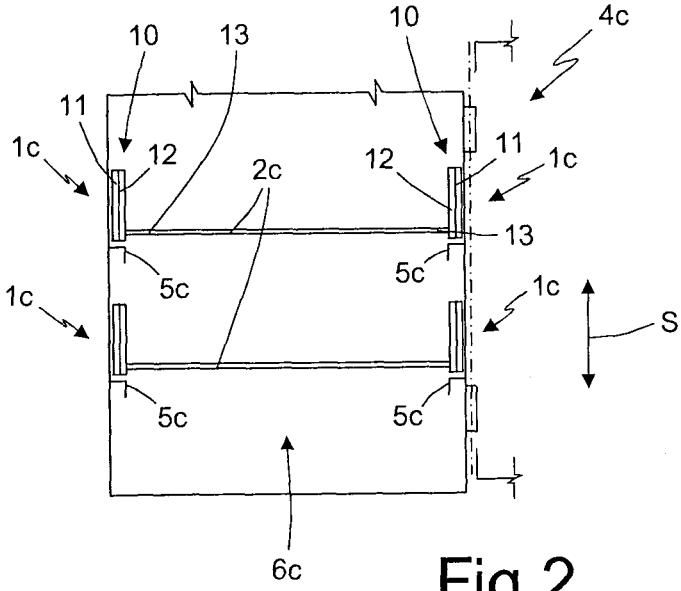

With reference to figures from 1 to 6, numerals 1*b*,1*c* indicate a supporting device for an inner supporting member 2*b*,2*c* of an electric household appliance 4*b*,4*c*. In the non-limitative case shown, the inner member 2*b* is an upper rack of a dishwasher 4*b*, mounted in an extractable manner, by means of rollers 5*b*, along fixed guides 5 in an inner compartment 6*b*, in this case a washing compartment, of the electric household appliance 4*b*; or it is an inner supporting shelf 2*c* of a refrigerator or freezer 4*c*, mounted on fixed guides 5*c* in a refrigerated compartment 6*c*. In figures from 3 to 6, the device of the invention is described and illustrated with reference to the device 1*b* applied to a rack 2*b* of a dishwasher 4*b*.

It is however apparent that the description identically also applies to the device 1*c*, both the devices 1*b* and 1*c* comprising a support 10 securable in use by means of a first part 11 thereof to a fixed guide 5*b*,5*c* and by means of a second part 12 thereof, opposite to and facing the first, to a side edge 13 of the inner element 2*b*,2*c*, the second part 12 of the support 10 being movably carried by the first part 11 in a relative sliding direction S therebetween, which direction is perpendicular to the laying plane of the inner supporting member 2*b*,2*c* concerned at the time. The only difference between the devices 1*b* and 1*c* is that the part 11 directly engages the guides 5*c* in the device 1*c*, while, in the device 1*b*, it engages the guides 5 by means of the rollers 5*b*, in a known manner, so as to allow the rack 2*b* to be extracted from the washing compartment 6*b*.

With reference hereinafter to figures from 3 to 6 only, the device 1*b* of the invention (i.e. also 1*c*) further comprises releasable retaining means 15 (FIGS. 4, 5) for blocking the second part 12 with respect to the first part 11 in a plurality of different positions along the relative sliding direction S, which retaining means 15 comprise a pin 20 carried by the part 11 of the support 10 overhangingly protruding towards the second part 12 in a transversal direction to the fixed guide 5, in use, and a desmodromic sliding track 22 for a free end 23 (i.e. the protruding end) of the pin 20.

Figure 6:
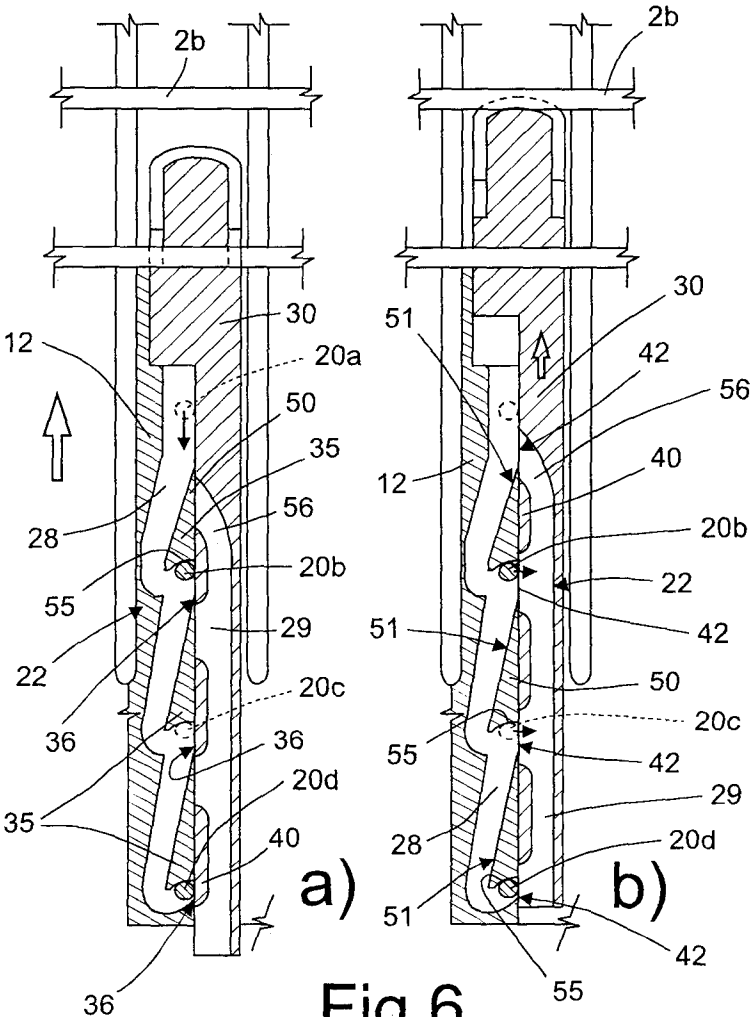
FIGS. 6*a*) and 6*b*) show some constructional details of the supporting device of the invention on enlarged scale and partially in section on the plane in FIG. 4.

The pin 20 is further carried so as to slide on the first part 11 of the support 10 against the bias of first elastic means 25 in a direction D which is parallel, in use, to the fixed guide 5 and thus perpendicular to the sliding direction S and parallel to the laying plane of the rack 2*b*, while the track 22 is divided into a first branch 28 and a second branch 29 (FIG. 6) integrally obtained, respectively, within the second part 12 of the support 10 and, according to the invention, within a slide 30; in particular, the branches 28 and 29 are integrally obtained in one piece with the part 12 and with the slide 30, respectively.

Figure 3:
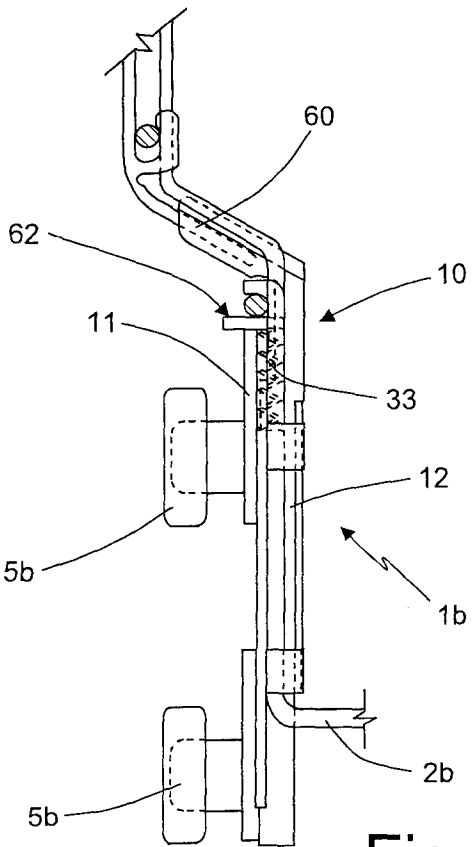
FIG. 3 shows a front elevation view on enlarged scale of a part of the supporting device of the invention applied to the electric household appliance in FIG. 1.
Figure 5:
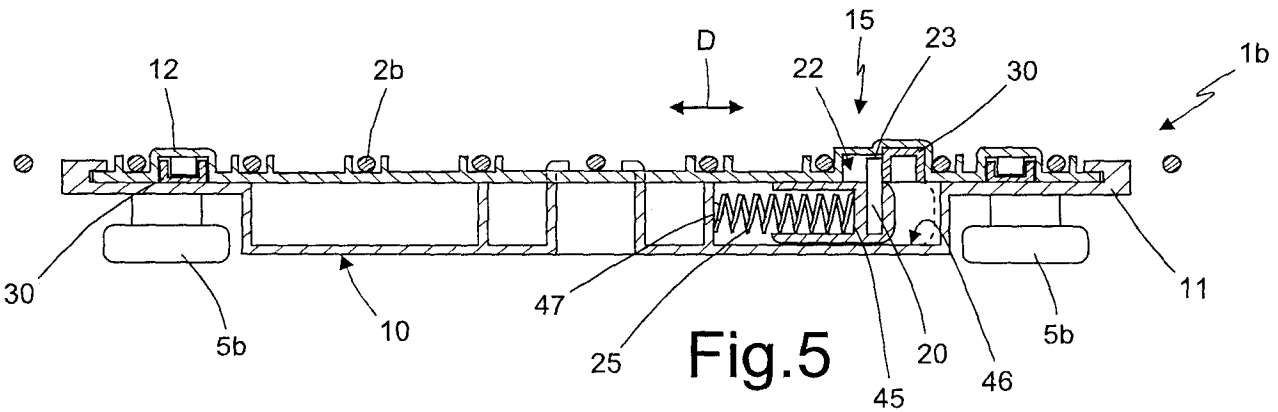

The slide 30 is in turn carried by the second part 12 of the support 10 so as to slide against the bias of second elastic means 33 (FIG. 3) in the relative sliding direction S between the latter and the first part 11, in this case sandwiched between the parts 11 and 12 (FIG. 5).

The first branch 28 is provided with a plurality of resting teeth 35 for the pin 20, arranged in sequence along the sliding direction S and aligned with an equivalent number of first openings 36 facing the second branch 29 and the latter is separated from the first branch by a wall 40 of the slide 30, displaying a plurality of second openings 42 for the pin 20 facing the first branch 28 and held, by the second elastic means 33, normally offset from the first openings 36 in the relative sliding direction S, i.e. in the position shown in FIG. 6*a*.

Figure 4:
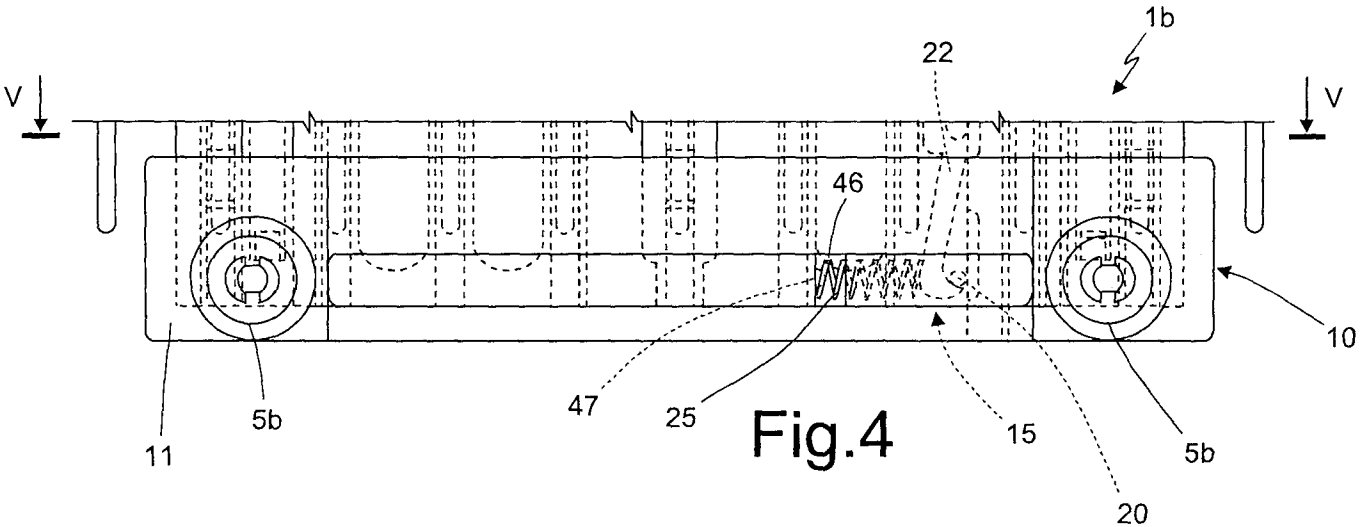
FIGS. 4 and 5 are a longitudinal elevation view and a section view, respectively, along a plotting plane V-V of the supporting device in FIG. 3 applied to an inner supporting member, in this case a rack, of the electric household appliance in FIG. 1.

In this case, the first elastic means 25 are mounted so as to be preloaded in their seat on the part 11 of the support 10 and push the pin 20, transversally to its axis, against the wall 40 of the slide 30 which separates the second branch 29 of the desmodromic track 22 from the first branch 28. In particular, the pin 20 is integrally carried by a cursor 45, in which it is transversally and protrudingly driven on a side thereof facing the second part 12 of the support 10; the cursor 45 is, in turn, mounted so as to slide within a guide 46 obtained on the first part 11 of the support 10 facing the second part 12 and from which the free end 23 of the pin 20 overhangingly protrudes within the desmodromic track 22. As shown in FIGS. 4 and 5, the first elastic means consist in a helical spring 25 sandwiched between the cursor 45 and a closed bottom end 47 of the guide 46, which therefore acts also as a housing seat for the spring 25.

In the example shown, the first openings 36 are laterally obtained through a longitudinal ridge 50 integrally carried in one piece by the second part 12 of the support 10 and parallelly aligned to the relative sliding direction S, so as to separate the first branch 28 of the track 22 from the second branch 29 along with the wall 40, with respect to which it is thus parallelly aligned and cooperates in contact.

The ridge 50 overhangingly projects toward the first part 11 of the support 10 and is integrally provided, towards the first branch 28 of the track 22, with the teeth 35 which are saw-tooth-shaped in the relative sliding direction S. In combination, the first branch 28 of the track 22 is shaped in a conjugated manner with the shape of the resting teeth 35, so that every relative sliding between the first part 11 and the second part 12 of the support 10 produces a thrust on the pin 20 by means of respective inclined planes 51 of the teeth 35 (FIG. 6*b*), so as to displace the pin against the bias of the elastic means 25, transversally to the longitudinal ridge 50 and to the second wall 40 of the slide 30, which slidingly cooperates against the longitudinal ridge 50, on the part opposite to the branch 28 and thus on the side of the ridge 50 opposite to the one provided with the teeth 35.

The teeth 35 are shaped so as to define an equivalent number of supporting shoulders 55 for the free end 23 of the pin 20 along the relative sliding direction S, by means of which the first part 11 of the support 10 bears in use the second part 12 by means of the pin 20 itself; furthermore, according to a further feature of the invention, the second branch 29 of the desmodromic track 22 is longer than the longitudinal ridge 50 and ends on the side opposite to the shoulders 55, with a curved end 56 facing the first branch 28 and aligned with an opening 42.

In the case shown, the second elastic means 33 consist of a spring mounted so as to be preloaded and sandwiched between the slide 30 and the second part 12 of the support 10 in the relative sliding direction S, so as to allow, in use and against the bias of the spring 33, a relative movement between the slide 30 and the second part 12 of the support 10 in the direction of the arrow (FIG. 6) in order to produce the alignment between the first openings 36 and the second openings 42 (FIG. 6*b*) so as to interconnect the first branch 28 and the second branch 29 of the desmodromic track 22 in a selective manner only; in any case, the selective connection simultaneously occurring both at all the teeth 35 and at the curved end 56 of the second branch 29, thus allowing the pin 20 to selectively engage the first branch 28 and the second branch 29 of the desmodromic track 22 according to the relative position between the slide 30 and the part 12 of the support 10.

The slide 30 is preferably provided with a handle 60 adapted to allow a user to manually produce, in use, the relative movement between the slide 30 and the part 12 of the support 10. In any case, the first part 11 and second part 12 of the support 10 are made so as to selectively take, in use, along the relative sliding direction S, a stroke end position in which the first part 11 directly supports the second part 12 by means of a shoulder 62 thereof (FIG. 3), and in which the pin 20 engages the first branch 28 of the desmodromic track 22 without engaging any resting tooth 35, i.e. it is in the position shown with a dashed line in FIG. 6*a* and indicated by numeral 20*a*. The other positions which may be selectively taken by the pin 20 on the track 22 along the branch 28 are diagrammatically shown in FIG. 6, partially with a dashed line, partially with a solid line and in bold print, and are indicated with numerals 20*b*, 20*c*, 20*d*, respectively.

In use, by virtue of the described supporting device, the rack 2*b* may selectively take a first position, in this case the lowest position, when the part 12 rests in abutment against the shoulder 62 of part 11, and other three gradually higher positions, as the pin 20 slides along the branch 28 to selectively engage, in sequence, the teeth 35 one after the other, it being sufficient to simply exert an upward push on the rack 2*b* to obtain such a movement.

In order to return the rack 2*b* to the starting position (the lowest position) it is sufficient, in any of the most raised positions, to make the slide 30 relatively slide with respect to the part 12 of the support 10, e.g. by directly acting on the handle 60, or by producing, in the stroke end position 20*d*, a further upward push of the rack 2*b*; this indeed produces the instantaneous alignment of all the openings 36 with all the openings 42, thus allowing the spring 25 to force the pin 20 to pass into the branch 29, where it then slides upwards due to the gravity (to the weight of the rack 2*b*) at the end being returned to the branch 28 by the curved end 56, approximately close to the downward stroke end position of the rack 2*b*.

The invention claimed is:

1. A supporting device for an inner supporting member of an electric household appliance, said supporting device comprising:

a support including a first part securable in use to a fixed guide provided at an inner compartment of the electric household appliance, and a second part, opposite to and facing the first part, securable in use to a side edge of the inner supporting member of the electric household appliance, the second part of the support being movably carried by the first part in a relative sliding direction, the second part adapted to be perpendicular to a laying plane of the inner supporting member; and a releasable retaining element for blocking the second part with respect to the first in a plurality of different positions along said relative sliding direction, wherein the releasable retaining element comprises:

a pin carried by the first part of the support and having a free end overhangingly protruding towards the second part of the support in a transverse direction perpendicular to the relative sliding direction;

a first elastic member, the pin being slidable on the first part of the support against bias of the first elastic member in the transverse direction;

a second elastic member; and a desmodromic sliding track along which the free end of the pin is movable, and the track including a slide that is slidingly carried against bias of the second elastic member by the second part of the support in the relative sliding direction between the second part and the first part of the support, the track being divided into a first and a second branches, integrally formed, respectively, within the second part of the support and within the slide, wherein the first branch of the track includes a plurality of first openings facing the second branch and a plurality of resting teeth for the pin, which are arranged in sequence along said relative sliding direction and aligned with an equal number of the first openings facing the second branch, and the second branch of the track is separated from the first branch by a wall of the slide having a plurality of second openings for the pin which are facing the first branch and are held by the second elastic member in an offset position from the first openings in the relative sliding direction.

2. A device according to claim 1, wherein said first elastic member is preloaded and pushes said pin, in the relative sliding direction, against said wall of the slide which separates the second branch of the desmodromic sliding track from the first branch.

3. A device according to claim 2, wherein said pin is integrally carried by a cursor and said pin is transversally and protrudingly fitted on a side of the cursor facing the second part of the support, the cursor is slidingly mounted within a guide of the first part of the support facing the second part, and the free end of the pin overhangingly protrudes from the guide and within said desmodromic sliding track.

4. A device according to claim 3, wherein said first elastic member comprises a helical spring sandwiched between said cursor and a closed end of said guide.

5. A device according to claim 1, wherein the second part of the support further comprises a longitudinal ridge extending in the relative sliding direction, said first openings are formed through the longitudinal ridge in the transverse direction and are aligned with each other along the relative sliding direction, said ridge separates the first branch of the track from the second branch of the track, protrudingly projects towards the first part of the support, and is integrally provided with said resting teeth which are saw-tooth-shaped, and said resting teeth project toward the first branch of the track.

6. A device according to claim 5, wherein said first branch of the track is shaped in a conjugated manner with said resting teeth, so that a relative sliding between the first and the second parts of the support produces, by corresponding inclined planes of said teeth, a thrust on the pin so as to displace the pin against the bias of the first elastic member, transversally to said longitudinal ridge of the second part of the support and to said wall of the slide, the wall of the slide slidingly cooperates against said longitudinal ridge.

7. A device according to claim 5, wherein said teeth define along said relative sliding direction an equivalent number of supporting shoulders for supporting the free end of the pin, the second branch of the desmodromic sliding track is longer than said longitudinal ridge of the second part of the support and is located opposite to said shoulders, and said second branch has a curved end facing the first branch and aligned with one of said second openings.

8. A device according to claim 1, wherein said second elastic member comprises a spring preloaded and sandwiched between the slide and the second part of the support in said relative sliding direction, so as to allow a relative movement between the slide and the second part of the support against the bias of the spring, in order to produce the alignment between the first and the second openings so as to connect together the first and the second branches of the desmodromic sliding track to allow the pin to selectively engage the first and the second branches of the desmodromic sliding track.

9. A device according to claim 8, wherein said slide is provided with a handle adapted to allow a user to manually produce, in use, said relative movement between the slide and the second part of the support.

10. A device according to claim 1, wherein said first and second parts of the support are configured to selectively take, in use, along said relative sliding direction, a stroke end position in which the first part directly supports the second part by a shoulder thereof, and in which the pin engages the first branch of the desmodromic sliding track without engaging said teeth.

* * * * *